US011352689B2

(12) United States Patent
Mainville

(10) Patent No.: US 11,352,689 B2
(45) Date of Patent: Jun. 7, 2022

(54) METHOD AND SYSTEM FOR COOLING METAL PARTS AFTER NITRIDING

(71) Applicant: INDUSTRIES MAILHOT INC., Terrebonne (CA)

(72) Inventor: Luc Mainville, Joliette (CA)

(73) Assignee: INDUSTRIES MAILHOT INC.

( * ) Notice: Subject to any disclaimer, the term of this patent is extended or adjusted under 35 U.S.C. 154(b) by 180 days.

(21) Appl. No.: 16/629,751

(22) PCT Filed: Jul. 5, 2018

(86) PCT No.: PCT/CA2018/050823

§ 371 (c)(1),
(2) Date: Jan. 9, 2020

(87) PCT Pub. No.: WO2019/006554

PCT Pub. Date: Jan. 10, 2019

(65) Prior Publication Data

US 2020/0173010 A1 Jun. 4, 2020

Related U.S. Application Data

(60) Provisional application No. 62/529,505, filed on Jul. 7, 2017.

(51) Int. Cl.

| | |
|---|---|
| ***C23C 8/80*** | (2006.01) |
| ***C23C 8/50*** | (2006.01) |
| ***C23C 8/56*** | (2006.01) |
| *C21D 1/62* | (2006.01) |

(52) U.S. Cl.

CPC ..... *C23C 8/80* (2013.01); *C23C 8/50* (2013.01); *C23C 8/56* (2013.01); *C21D 1/62* (2013.01)

(58) Field of Classification Search

CPC ..... C23C 8/80; C23C 8/50; C23C 8/56

See application file for complete search history.

(56) References Cited

U.S. PATENT DOCUMENTS

| | | | |
|---|---|---|---|
| 3,560,271 | A | 2/1971 | Heinen |
| 9,464,346 | B2 | 10/2016 | Michalot et al. |
| 2013/0327445 | A1 | 12/2013 | Chavanne et al. |
| 2014/0216608 | A1 | 8/2014 | Michalot et al. |

FOREIGN PATENT DOCUMENTS

| | | | |
|---|---|---|---|
| CA | 2869018 | A1 | 8/2014 |

OTHER PUBLICATIONS

International Search Report issued in the Application No. PCT/CA2018/050823 dated Sep. 12, 2018.

*Primary Examiner* — Jessee R Roe

(74) *Attorney, Agent, or Firm* — Lavery, De Billy, LLP; Gwendoline Bruneau

(57) ABSTRACT

A method and a system for cooling treating metal parts exiting a nitriding/nitrocarburizing treatment in molten salt baths, comprising a cooling chamber in direct relation with a nitriding/nitrocarburizing station for receiving parts therefrom; a gaseous nitrogen feeding unit connected to the cooling chamber and configured to create an inert atmosphere within the cooling chamber; and a screened transfer path between the nitriding/nitrocarburizing station and the cooling chamber; wherein after exiting molten salt baths of the nitriding/nitrocarburizing station, the treated parts are transferred to the cooling chamber through the screened transfer path, and cooled therein to a minimum temperature above a temperature at which salts congeal.

10 Claims, 2 Drawing Sheets

METHOD AND SYSTEM FOR COOLING METAL PARTS AFTER NITRIDING

CROSS-REFERENCE TO RELATED APPLICATIONS

This application is a National Entry Application of PCT application no PCT/CA2018/050823 filed on Jul. 5, 2018 and published in English under PCT Article 21(2), which itself claims benefit of U.S. provisional application Ser. No. 62/529,505, filed on Jul. 7, 2017. All documents above are incorporated herein in their entirety by reference.

FIELD OF THE INVENTION

The present invention relates to cooling metal parts having undergone a nitriding/nitrocarburising treatment in a molten salt bath. More specifically, the present invention is concerned with a method and system for cooling metal parts after nitriding.

BACKGROUND OF THE INVENTION

Thermochemical diffusion of nitrogen by nitriding or nitrocarburizing in baths of molten salts, generally comprising cyanate and alkaline carbonate, is used to reduce the coefficient of friction and improve the adhesive and abrasive wear resistance of metal parts. When the nitriding temperature is reached, the alkaline cyanate releases nitrogen and carbon which diffuse over the surface of the part. The treatment times are generally between 20 and 180 minutes at temperatures in the range between about 400 and about 700° C.

These processes are most commonly used on low alloys and alloy steels.

Typical applications include gears, crankshafts, camshafts, cam followers, valve parts, extruder screws, die-casting tools, forging dies, extrusion dies, firearm components, injectors and plastic-mold tools for example.

The nitriding treatment process typically comprises degreasing the parts, preheating, nitrocarburizing treatment, cooling, rinsing, and drying.

Industrial solutions for ensuring nitriding or nitrocarburizing of metal parts minimizing oxidation have been developed.

There is still a need in the art for a method and a system for cooling metal parts after nitriding.

SUMMARY OF THE DISCLOSURE

More specifically, in accordance with the present disclosure, there is provided a method comprising treating metal parts for nitriding/nitrocarburizing in molten salt baths; creating an inert atmosphere within the cooling chamber; transferring the treated metal parts to the cooling chamber; and cooling the parts within the cooling chamber to reach a minimum temperature above a temperature at which salts congeal.

There is further provided a system for cooling treating metal parts exiting a nitriding/nitrocarburizing treatment in molten salt baths, comprising a cooling chamber in direct relation with a nitriding/nitrocarburizing station for receiving parts therefrom; a gaseous nitrogen feeding unit connected to the cooling chamber and configured to create an inert atmosphere within the cooling chamber; and a screened transfer path between the nitriding/nitrocarburizing station and the cooling chamber; wherein after exiting molten salt baths of the nitriding/nitrocarburizing station, the treated parts are transferred to the cooling chamber through the screened transfer path, and cooled therein to a minimum temperature above a temperature at which salts congeal.

Other objects, advantages and features of the present disclosure will become more apparent upon reading of the following non-restrictive description of specific embodiments thereof, given by way of example only with reference to the accompanying drawings.

DESCRIPTION OF EMBODIMENTS OF THE INVENTION

Figure 1:
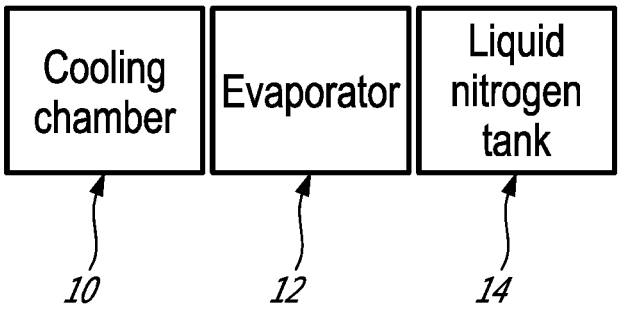
FIG. 1 is a diagrammatic view of a system according to an embodiment of an aspect of the present invention.

According to an embodiment of an aspect of the present invention, liquid nitrogen for example typically stored in a liquid nitrogen tank 14 located outdoors, is sent to an evaporator 12 so as to feed a cooling chamber 10 from below using inlets 14 positioned at a bottom thereof, with gaseous nitrogen, within the plant (see FIG. 1). Another gas may be to discharge the oxygen out of the cooling chamber 10, such as Argon for example.

The cooling chamber 10 is placed in direct relation with a nitriding/nitrocarburizing station (not shown) for receiving parts therefrom, transferred from the molten salt baths of the nitriding/nitrocarburizing station.

Figure 2:
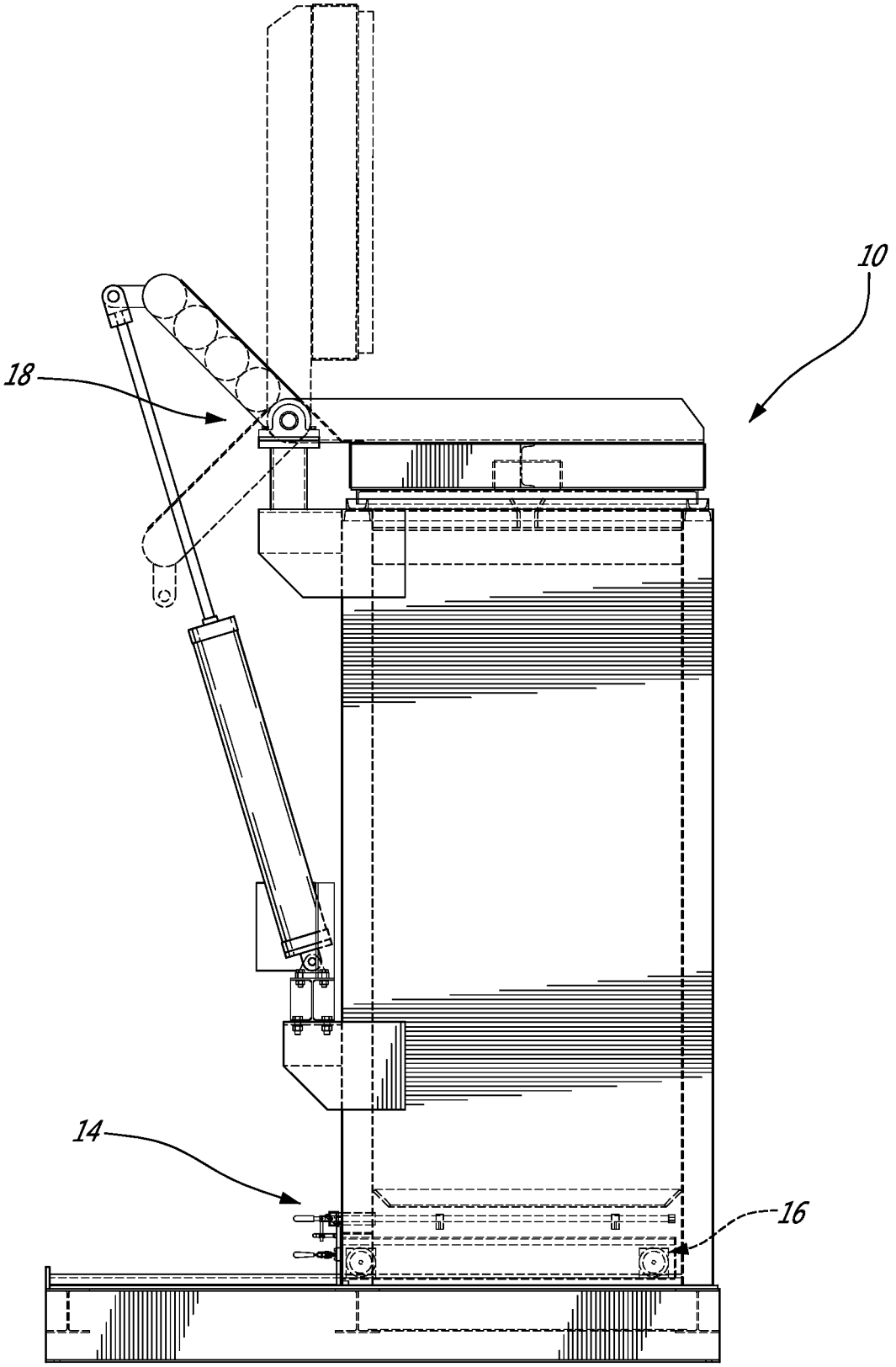
FIG. 2 show a cooling chamber according to an embodiment of an aspect of the present invention.

The cooling chamber 10 is shown for example in FIG. 2 as a double-walled steel chamber, with a lid 18 for closing the chamber against oxygen penetration and a bottom drawer 16 for salt recovering.

The cooling chamber 10 is first submitted to an oxygen purge by flushing through at least four times its volume with gaseous nitrogen for example, thereby creating therein an inert atmosphere. After this initial purge, the cooling chamber 10 is in operation mode, i.e. ready to receive parts from molten salt baths of the nitriding/nitrocarburizing station, as gaseous nitrogen is continuously fed to the cooling chamber 10, at a flow rate typically in a range between about 400 and about 1000 $pi^3/h$.

After exiting the molten salt baths at a temperature in a range between about 540° C. and about 650° C. in the nitriding/nitrocarburizing station, the treated parts are transferred to the cooling chamber 10 for a metallurgically slow cooling in the inert atmosphere of the cooling chamber 10.

The transfer is performed in a limited time, for example not more than 8 minutes, for example at a rate of at about 6 m/mm depending on the distance to be covered from the nitriding/nitrocarburizing station, so as to prevent action from ambient oxygen. During this transfer, the parts may be protected against air flows by a steel screen as to minimize convection effects of ambient air thereon. Such a screen contributes to prevent hot corrosion of the parts being transferred, as they are still covered with melted salts from the nitriding/nitrocarburizing station.

The cooling within the cooling chamber 10 is done to reach a minimum temperature in a range between about 400 and about 450° C., i.e. a temperature above a temperature at which salts congeal, so as to prevent formation of a crust on the parts, which may be difficult to remove once formed. Then the parts are transferred to a rinsing bath at a temperature in a range between about 40 and 50° C. and to a stop bath at a temperature of about 20° C., in which the parts are also rinsed.

It was found that such method prevents distortion of the treated parts, i.e. geometrical variations that may otherwise occur during quenching: for example, a precision tube 6"×5.5" may distort 0.20" on its diameter, while preventing surface oxidation of the parts, for parts in carbon steel, low alloy and alloy steel.

The scope of the claims should not be limited by the embodiments set forth in the examples, but should be given the broadest interpretation consistent with the description as a whole.

What is claimed is:

1. A method, comprising:

treating metal parts for nitriding/nitrocarburizing in molten salt baths;

creating an inert atmosphere within a cooling chamber;

transferring the treated metal parts from the molten salt baths to the cooling chamber; and cooling the parts within the cooling chamber to reach a minimum temperature above a temperature at which salts congeal, wherein said creating the inert atmosphere within the cooling chamber comprises feeding the cooling chamber with refrigerant in gaseous form.

2. The method of claim 1, wherein said nitriding/nitrocarburizing is performed in the molten salt baths at a temperature in a range between 540° C. and 650° C.

3. The method of claim 1, wherein the minimum temperature is about 450° C.

4. The method of claim 1, wherein the minimum temperature is comprised in a range between 400° C. and 450° C.

5. The method of claim 1, wherein the treated metal parts exit the molten salt baths at a temperature in a range between 540° C. and 650° C.

6. The method of claim 1, wherein said transferring the treated metal parts to the cooling chamber comprises protecting the treated parts from ambient air.

7. The method of claim 1, further comprising transferring the parts once cooled to a rinsing bath.

8. A method, comprising:

treating metal parts for nitriding/nitrocarburizing in molten salt baths;

creating an inert atmosphere within a cooling chamber;

transferring the treated metal parts from the molten salt baths to the cooling chamber; and cooling the parts within the cooling chamber to reach a minimum temperature above a temperature at which salts congeal, the method comprising continuously feeding the cooling chamber with a refrigerant in gaseous form at a flow rate comprised in a range between 400 and 1000 $pi^3/h$.

9. A method, comprising:

treating metal parts for nitriding/nitrocarburizing in molten salt baths;

creating an inert atmosphere within a cooling chamber;

transferring the treated metal parts from the molten salt baths to the cooling chamber; and cooling the parts within the cooling chamber to reach a minimum temperature above a temperature at which salts congeal, the method further comprising transferring the parts once cooled to a stop bath.

10. A method, comprising:

treating metal parts for nitriding/nitrocarburizing in molten salt baths;

creating an inert atmosphere within a cooling chamber;

transferring the treated metal parts from the molten salt baths to the cooling chamber; and cooling the parts within the cooling chamber to reach a minimum temperature above a temperature at which salts congeal, the method further comprising transferring the parts once cooled to a rinsing bath at a temperature in a range between 40 and 50° C. and then to a stop bath at a temperature of 20° C.

* * * * *